US007387547B1

(12) United States Patent
Fuzetti

(10) Patent No.: US 7,387,547 B1
(45) Date of Patent: Jun. 17, 2008

(54) BUSBAR ASSEMBLY

(75) Inventor: Vagner Fuzetti, Braganca-SP (BR)

(73) Assignee: Tyco Electronics Brasil LTDA, Sao Paulo (BR)

( * ) Notice: Subject to any disclaimer, the term of this patent is extended or adjusted under 35 U.S.C. 154(b) by 19 days.

(21) Appl. No.: 11/563,313

(22) Filed: Nov. 27, 2006

(51) Int. Cl.
*H01R 11/09* (2006.01)

(52) U.S. Cl. ..... 439/798; 439/812

(58) Field of Classification Search ..... 439/798, 439/797, 796, 811, 812, 727, 810, 709
See application file for complete search history.

(56) References Cited

U.S. PATENT DOCUMENTS 2,232,602 A * 2/1941 Grace ..... 439/798
4,140,360 A 2/1979 Huber
6,664,478 B2 12/2003 Mohan et al.
6,854,996 B2 2/2005 Yaworski et al.
7,037,128 B2 5/2006 Yaworski et al.
7,048,591 B1 * 5/2006 Chiang ..... 439/709

* cited by examiner

*Primary Examiner*—Javaid Nasri

(57) ABSTRACT

Busbar assemblies are disclosed. The busbar assemblies allow electric current to be distributed through electrically conductive cables that are held in contact with a substantially solid conductive bar by a cable retention system that does not require through-holes in the conductive bar and which decrease the bar's current carrying capacity. Further, the cable retention system retains the cables in consistent contact with the bar and resist loosening due to vibration and thermal cycling.

17 Claims, 8 Drawing Sheets

BUSBAR ASSEMBLY

FIELD OF THE INVENTION

The present invention is directed to assemblies for distributing electric current and more particularly to busbar assemblies that distribute electric current across a conductive bar via conductive cables retained in electrical contact with the bar.

BACKGROUND OF THE INVENTION

For many years, busbar assemblies, such as those used in distribution boxes, have been used in a wide variety of domestic and industrial applications to provide a convenient means to supply relatively high electric currents (up to 5000 amps, for example). These assemblies are convenient from an electrical point of view and are relatively compact and easily accessible for maintenance purposes.

As shown in FIG. 7, prior art bolted busbar assemblies 200 have a conductive bar 240 with supports 250 at each end and contain multiple threaded through-holes 215 in which bolts 210 are positioned, which bolts 210 can be raised or lowered by loosening or tightening, respectively, in a conventional manner. A washer 220 or other retention device is generally provided intermediate the head of the bolt 210 and the conductive bar 250. Electrical cables 230 are then positioned on the bar 250 adjacent the bolts 210. When the bolts 210 are tightened, they descend into the through-holes 215. The bolt 210 is tightened until the washer 220 squeezes the cable 230 securely against the bar 240.

However, the through-holes 215 reduce current capacity by reducing the conductive cross-sectional area of the busbar 240. Furthermore, busbar assemblies are usually subjected to one or both of vibration and thermal stress during normal operating conditions. In conventional busbar assemblies 200, the bolts 210 have a tendency to loosen over time, reducing the clamping force on the cable 230 imparted by the washer 220. This can lead to interruptions in service and even the possibility that the cable 230 will slip from the assembly 200 and lose electrical contact entirely.

What is needed is a busbar assembly that overcomes these and other drawbacks found in current busbar assemblies.

SUMMARY OF THE INVENTION

According to an exemplary embodiment of the invention, a busbar assembly is disclosed. The busbar assembly comprises an electrically insulating busbar housing, a substantially solid electrically conductive bar supported and positioned within the busbar housing, and a cable retention system configured to separately retain a plurality of electrically conductive cables in electrical contact with a surface of the conductive bar in the absence of through-holes in the conductive bar.

According to another exemplary embodiment of the invention, a busbar assembly comprises an electrically insulating busbar housing having a plurality of cable ports and fastener ports formed therein, a plurality of threaded fasteners having a fastener axis, each fastener positioned in a different fastener port of the busbar housing, a substantially solid electrically conductive bar supported and positioned within the busbar housing and a plurality of cable holders. The conductive bar extends through the cable holders and each cable holder has a threaded fastener aperture configured to receive the threaded fastener and a cable aperture configured to receive an electrically conductive cable. The threads of the fastener are engaged with the threads of the fastener aperture and wherein the cable aperture is aligned with a corresponding cable port of the busbar housing.

One advantage of exemplary embodiments of the invention is that the conductive bar is substantially solid and does not include through-holes, thereby providing a greater cross sectional area and increasing current capacity without increasing the overall size of the conductive bar used.

Another advantage of exemplary embodiments of the invention is that conductive cables are held in tight physical and electrical contact with the conductive bar by a cable retention system, such as a cable holder and fastener combination, that resists loosening when the busbar assembly is subjected to vibration and thermal cycling.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Exemplary embodiments of the invention are directed to busbar assemblies that include a cable retention system that holds electrically conductive cables in contact with a substantially solid conductive bar without the need for through-holes in the bar that decrease its current carrying capacity.

Figure 1:
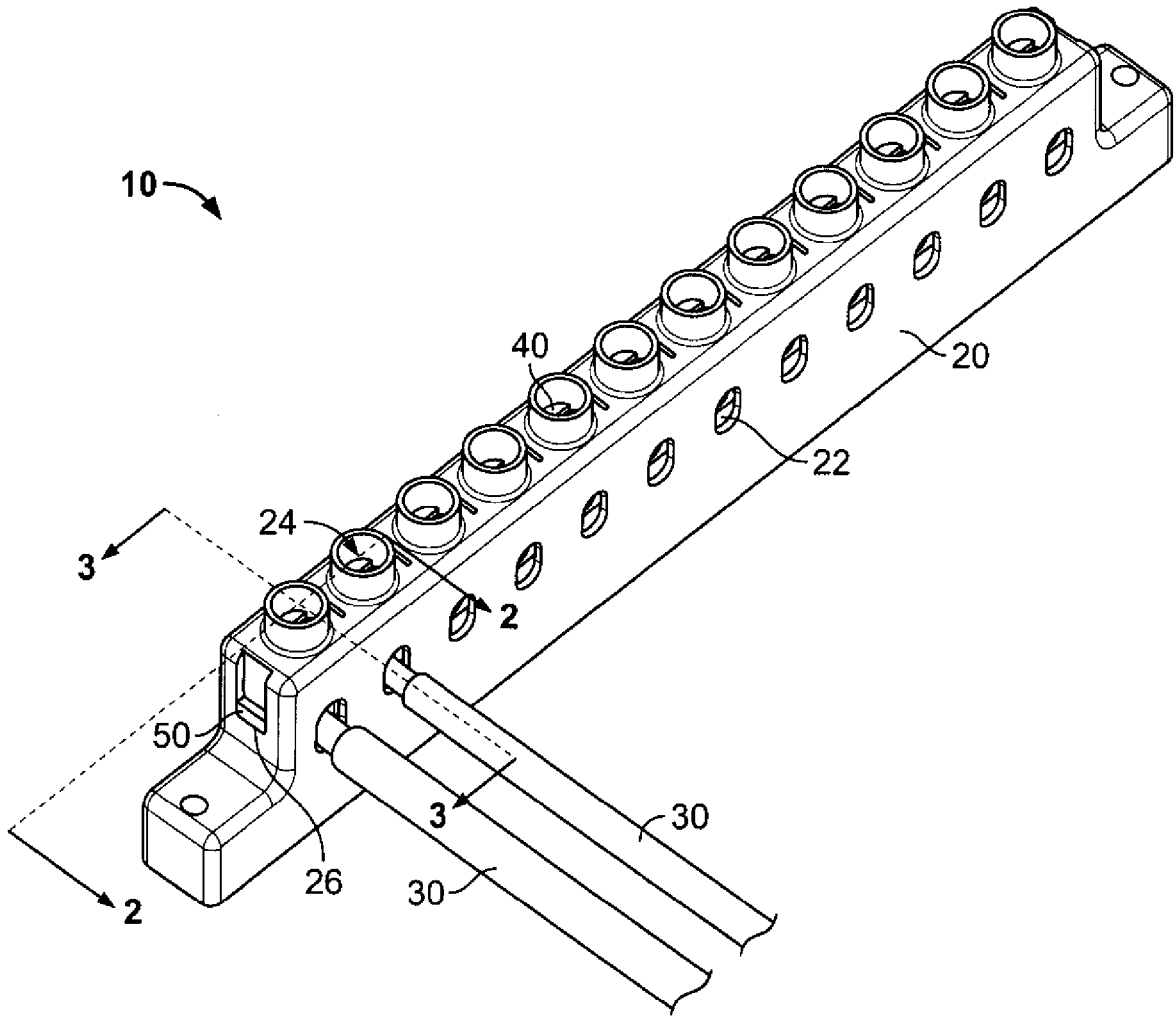
FIG. 1 illustrates a busbar assembly in accordance with an exemplary embodiment of the invention.

Referring to FIG. 1, a busbar assembly 10 includes an electrically insulating busbar housing 20 having a plurality of cable-receiving ports 22 for receiving conductive cables 30 to carry electric current. A substantially solid conductive bar 50 extends from a first end of the busbar housing 20 to a second end of the busbar housing 20 and completes an electric circuit between two or more cables 30 in contact with the bar 50. By "substantially solid" is meant that the conductive bar 50 has no through-holes, although pits, grooves, and other surface features of the bar 50 are not precluded. In one embodiment, the bar 50 has a substantially smooth surface and a uniform thickness.

The conductive bar 50 is supported within the busbar housing 20 by a ledge 26 molded or machined into the housing 20 adjacent each end of the housing 20.

The busbar assembly 10 includes a cable retention system 15 that are positionable to securely hold the cables 30 in contact with the conductive bar 50. As better seen in FIG. 2, in one embodiment the cable retention system 15 includes a plurality of ringed cable holders 60 and threaded fasteners 40 in combination with the cable holders 60 and that are used to draw the cable holders 60, and any cables 30 disposed therein, toward the conductive bar 50 and securely retain the cables 30 in contact therewith.

It will be appreciated that while the exemplary embodiments illustrated in FIGS. 1-6 include a cable retention system 15 having a cable holder 60 that works in combination with a threaded fastener 40, the invention encompasses any cable retention system 15 that securely holds cables 30 in contact with the surface of the conductive bar 50 and which also avoids the need for through-holes in the conductive bar 50.

For each cable port 22, the housing 20 also includes a fastener-receiving port 24 sized to receive a threaded fastener 40 positioned within the fastener port 24. As illustrated, the fastener port 24 is in a plane substantially orthogonal to the cable port 22, but the fastener and cable ports 24, 22 may be arranged in any suitable orientation with respect to one another.

The cable holders 60 are slipped over the conductive bar 50 such that the conductive bar 50 extends through each cable holder 60. Typically, one cable holder 60 is provided for each cable port 22, and each cable holder is generally individually used in combination with a single fastener 40 to retain the cable 30 within its respective cable port 22.

The cable holder 60 includes at least one cable receiving aperture 62 aligned with the cable port 22 and sized to receive the cable 30 when the cable 30 is inserted into the busbar assembly 10 through the cable port 22. The cable holder 60 is connected to the threaded fastener 40 by the fastener's threads 44 which are engaged with at least one threaded fastener aperture 64 in the cable holder 60. In this manner, the cable holder 60 can be adjusted from a reception position (FIG. 3*a*) for inserting or removing cables 30 to a retention position (FIG. 3*b*) for retaining cables 30 in the assembly 10 by turning the fastener 40 clockwise or counterclockwise.

Figure 2:
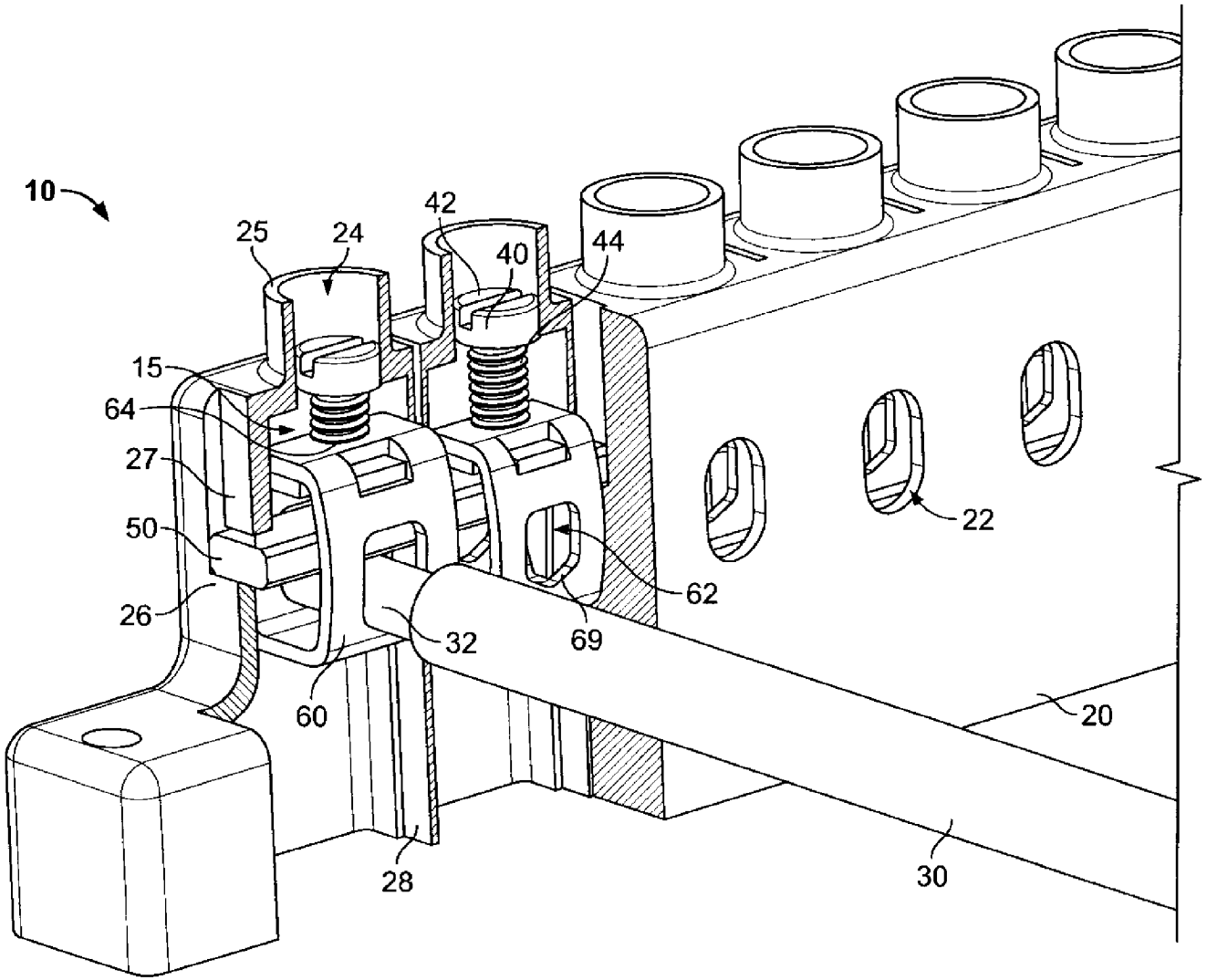
FIG. 2 illustrates an enlarged, cutaway view of the busbar assembly shown in FIG. 1 taken along line 2-2.
Figure 3A:
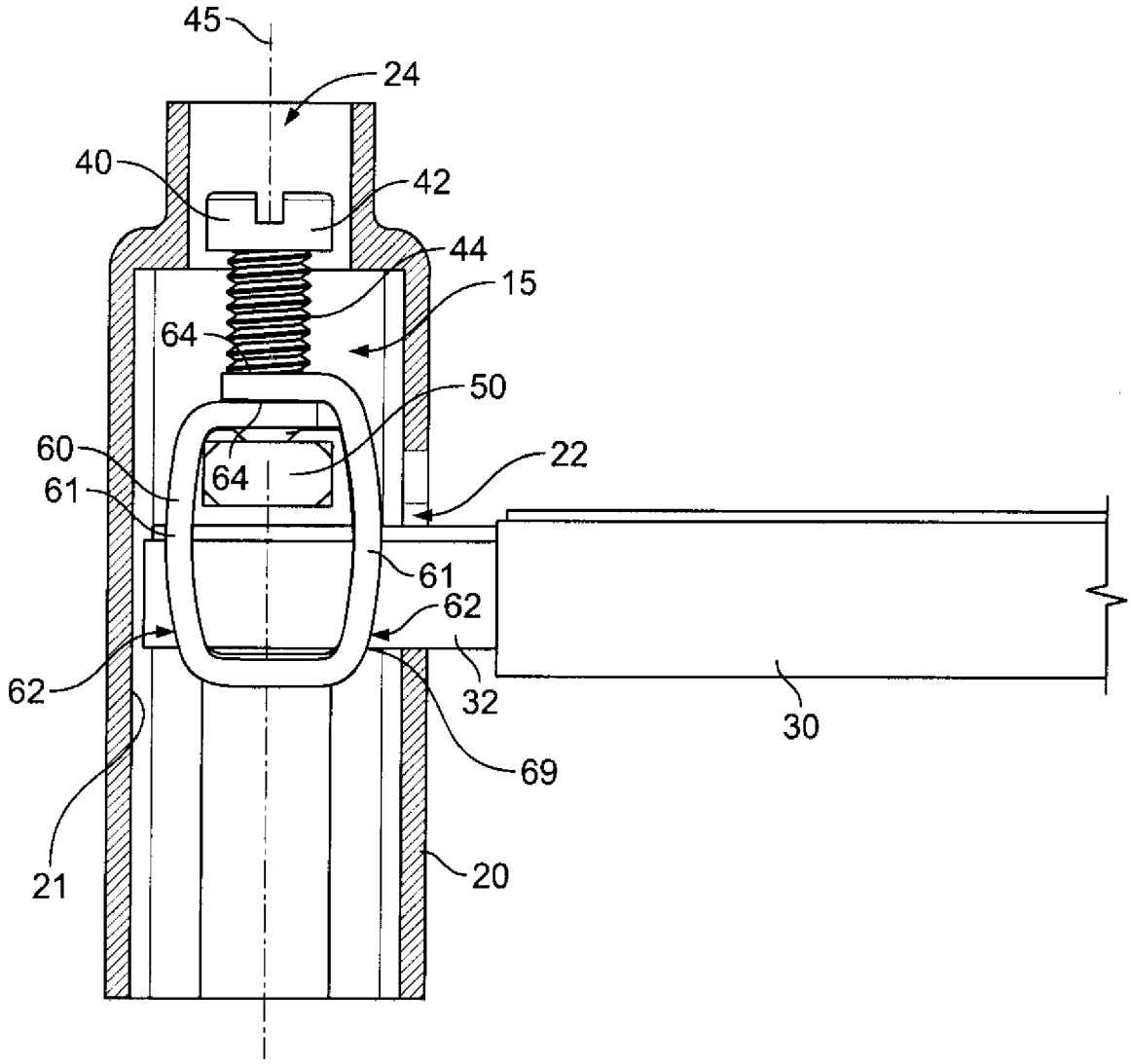
FIGS. 3*a* and 3*b* illustrate cross-sectional views of the busbar assembly shown in FIG. 1 taken along line 3-3.

FIG. 3*a* illustrates the cable holder 60 in a reception position. In this position, the cable 30 may be inserted into (or removed from) the busbar assembly 10. The cable 30 may or may not be insulated. It will be appreciated that if the cable 30 is insulated, at least the end 32 of the cable 30 is stripped of insulation prior to insertion into the busbar assembly 10 to permit electrical contact with the conductive bar 50. While the cable holder 60 is in the reception position, the exposed end 32 of the cable 30 is inserted through the cable port 22 and subsequently through the cable aperture 62 in a lateral wall 61 of the cable holder 60. The cable holder 60 is positioned along the length of the conductive bar 50 so that the cable aperture 62 is aligned with the cable port 22. The cable 30 rests on or in a base 69 of the cable aperture 62. FIG. 2 better illustrates the base 69 of the cable aperture 62 that supports the exposed end 32 of the cable 30 when inserted into the cable holder 60. In one embodiment, as illustrated in FIG. 2, the base 69 is concave, having a "v" or trough shape which may prevent lateral movement and provide consistent positioning of the cable 30 within the cable holder 60.

In one embodiment, as illustrated, the cable holder 60 includes two cable apertures 62 aligned with the cable port 22 so that the exposed end 32 of the cable 30 can be inserted completely through the cable holder 60 until it is stopped by a rear wall 21 of the busbar housing 20 opposite the cable port 22. This may provide a tactile confirmation to a user that the cable 30 has been sufficiently inserted into the busbar assembly 10 for operation. Preferably, the cable apertures 62 are transverse to the conductive bar 50, so that the inserted portion of the exposed end 32 of the cable 30 is substantially perpendicular to the conductive bar 50.

Figure 3B:
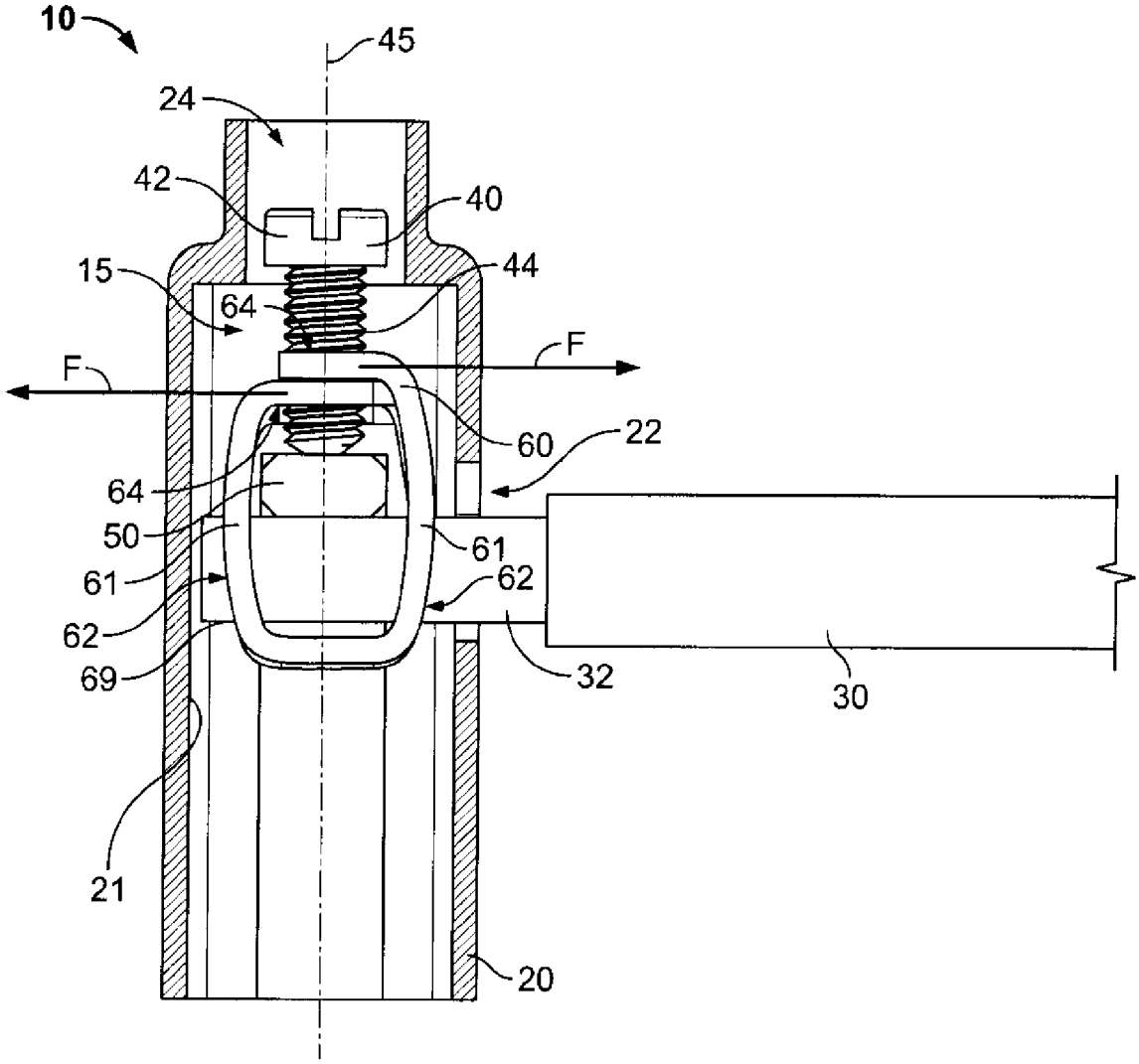

FIG. 3*b* illustrates the cable holder 60 in its retention position, to which the cable holder 60 is adjusted after the cable(s) 30 has been inserted by adjusting the fastener 40, i.e. actuating the fastener 40 in a manner that urges the cable holder 60 and the cable 30 toward the fastener port 24 in a direction coincident with the fastener's axis 45. Because the conductive bar 50 is substantially solid, the fastener 40 does not descend into or penetrate the conductive bar 50. Rather, the fastener 40 spins in place about its axis 45, the end of the fastener 40 opposite the fastener head 42 in abutting contact with the surface of the conductive bar 50.

However, because the threads 44 of the fastener 40 are engaged with the fastener aperture(s) 64 of the cable holder 60, sufficient turning of the fastener 40 urges the entire cable holder 60 toward the fastener port 24, pulling the cable 30 toward, and eventually against, the conductive bar 50. Continued actuation of the fastener 40 subjects the cable 30 to a compressive force between the bar 50 and the base 69 of the cable holder 60. This squeezes the cable 30 against the bar 50, retaining the cable 30 in the assembly 10 and holding it in electrical contact with the bar 50.

Returning to FIG. 2, the conductive bar 50 is substantially prevented from moving toward the fastener port 24 with the cable holder 60 and cable 30 by an end rib 27 disposed opposite, though not necessarily over, the ledges 26 that support the conductive bar 50 at each end of the busbar housing 20. Conversely, by actuating the fastener 40 in the opposite direction (i.e., going from the retention position to the reception position), the ledge 26 prevents the conductive bar 50 from moving away from the fastener port 24 as the cable holder 60 and cable 30 descend away from the fastener port 24 and the conductive bar 50.

Thus, the end rib 27 and ledge 26 together substantially rigidly retain the conductive bar 50 within the housing 20. For additional support, a plurality of intermediate ribs 28 (better seen in FIG. 6) may also be provided at various intervals within the housing 20. The intermediate ribs 28 may alternate between positions above or below the conductive bar 50 or, as shown, may be single ribs 28 individually positioned both above and below the conductive bar 50, which may be accommodated by a notch (not shown) formed in the rib 28.

The cable holder 60 is preferably resiliently configured in a manner that imparts a spring-like tension to the cable holder 60 to resist loosening of the fastener 40 in the presence of vibration and thermal cycling and thereby keep the cable 30 securely in contact with the conductive bar 50. One manner in which this may be achieved is by bending the cable holder 60 into a ring configuration from a unitary band.

Figure 5:
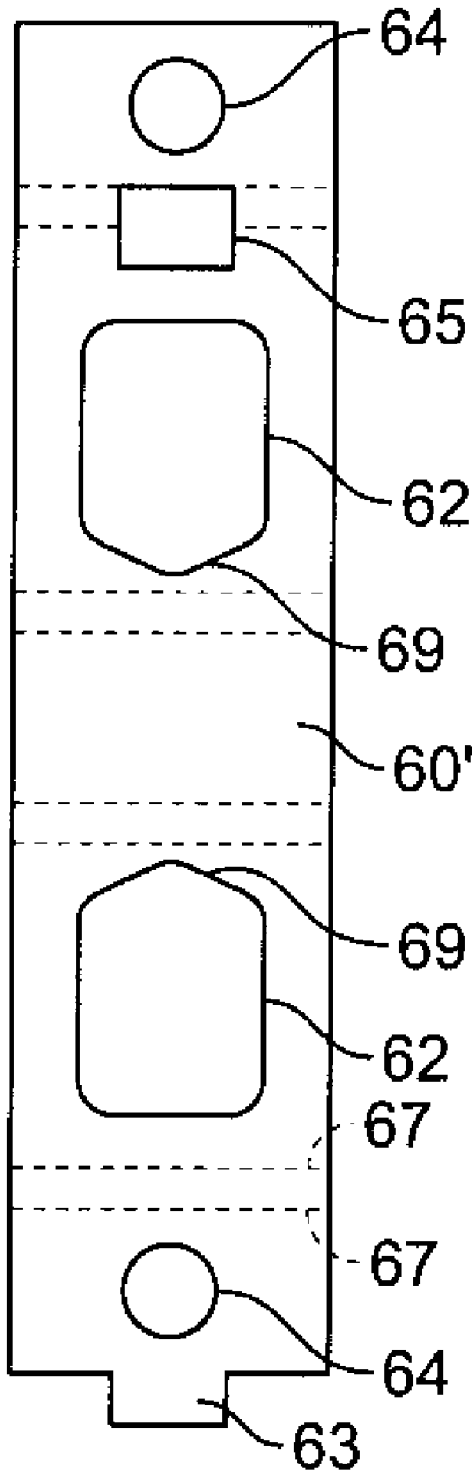
FIG. 5 illustrates a cable holder for use with busbar assemblies according to exemplary embodiments of the invention.
Figure 6:
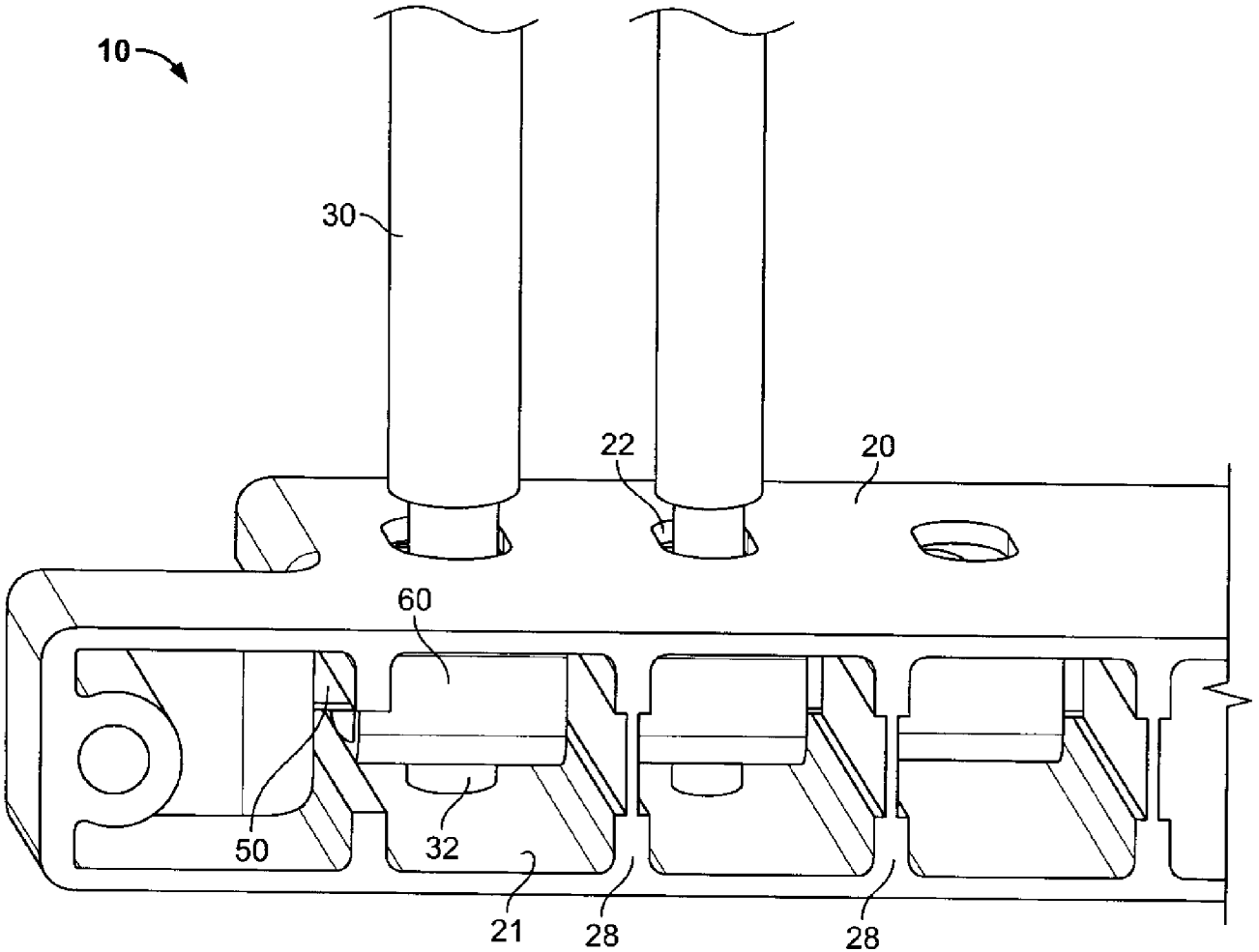
FIG. 6 illustrates an underside view of the busbar assembly in accordance with an exemplary embodiment of the invention.
Figure 7:
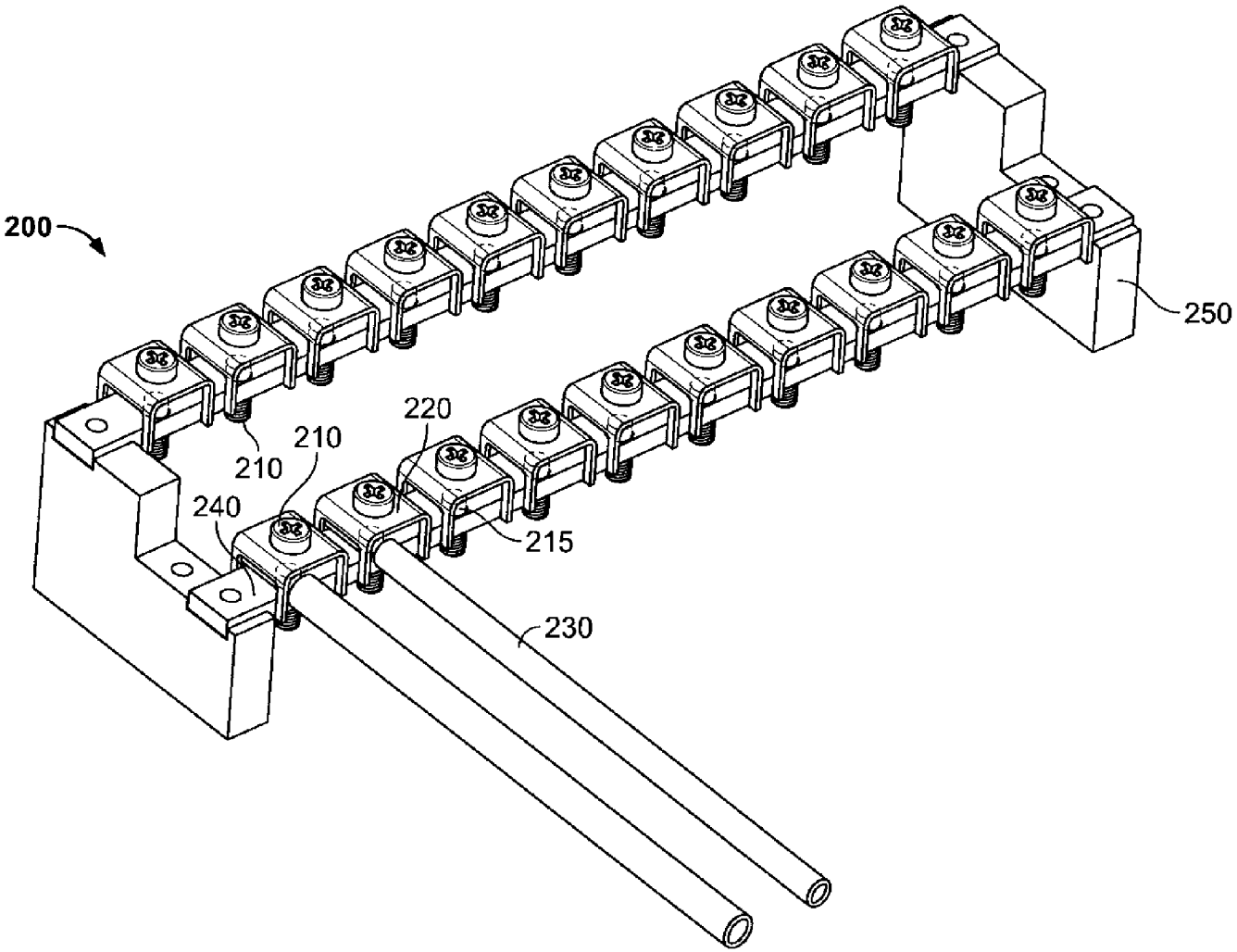
FIG. 7 (Prior Art)
FIG. 7 illustrates a prior art busbar assembly.

Referring to FIG. 5, according to one embodiment of the invention, the cable holder 60 is formed from a single band 60' or strip of material. A tab 63 is disposed at one end of the band 60'. The cable holder 60 is formed by bending the band from a linear configuration into a ring configuration, which results in the formation of lateral walls 61 (FIG. 3*a*) that assist in the cable holder's resistance to loosening. In some cases, it may be desirable to make the bends at one or more pre-determined bend positions (illustrated with a broken line 67), which may or may not be marked on the cable holder 60.

When formed into the ring configuration, the tab 63 is inserted into a corresponding slot 65 to at least temporarily retain the cable holder 60 in its ring configuration. The cable holder 60 also has two threaded fastener apertures 64; when in the ring configuration, the fastener apertures 64 are in substantial registration with one another to receive and engage the fastener 40. As best seen in the profile views of FIGS. 3*a* and 3*b*, the lateral walls 61 of the cable holder 60 are partially curved or bowed consistent with the ring-configuration of the cable holder 60. When the fastener 40 is tightened, i.e., the cable 30 is urged in a direction coincident the fastener axis 45, the lateral walls are tractioned, which retains stored energy imparted by the tightening process, retaining tension on the fastener 40 and generally preventing its loosening even when the assembly is subjected to vibration and thermal stresses during operation.

Furthermore, as a result of bending the cable holder 60 from a linear configuration to a ring configuration, the cable holder 60 is biased away from its naturally unbiased, linear configuration. The tendency of the cable holder 60 to at least partially return to its initial linear position by the imparted bias is typically referred to as "springback." Thus, when the fastener 40 is inserted through the fastener apertures 64, the cable holder 60, by virtue of springback, has a tendency to return toward its natural linear configuration, but is at least partially prevented from doing so by the fastener 40. As a result, the fastener 40 is subjected to opposing compressive forces (illustrated in FIG. 3*b* by arrows F) that are sufficient to resist loosening of the fastener 40 due to vibration and thermal cycling. However, the compressive forces can be overcome by the application of a sufficiently large external force to raise or lower the cable holder 60 to its reception or retention position. For example, a screw driver may be used to loosen or further tighten the fastener 40.

The busbar housing 20 may be constructed of any electrically insulating material, but is typically a plastic so that the housing 20 can be produced by injection molding or other similar mass production technique convenient for providing the plurality of cable ports 22 and fastener ports 24.

The conductive bar 50 can be any substantially solid bar of electrically conductive material, and is preferably a metal such as copper, silver, gold, platinum, aluminum, tin, palladium, and/or alloys thereof, by way of example only. The conductive bar 50 may further include one or more electrically conductive layers partially or fully plated over a base material, such as a solid bar of tin overplated with copper, for example. The dimensions of the conductive bar 50 may vary depending on the overall dimensions of the busbar assembly 10, although the thickness selected should be suitable for use with the overall current capacity desired to be achieved by the busbar assembly 10.

The cable holders 60 and fasteners 40 may be of any material, whether or not electrically conductive, provided the cable holders 60 exhibit sufficient resilience/springback behavior as described above. Conductive materials for the cable holders 60 and fasteners 40 include stainless steel and common steel with an optional corrosion protection, by way of example only. If constructed of a conductive material, the fasteners 40 are preferably recessed from the surface of the busbar housing 20 to avoid the risk of a short circuit and/or electrical shock. In one embodiment, this may be achieved through the use of parapets 25 that extend away from the surface of the busbar housing 20 in which the fastener ports 24 are located.

Any suitable style of threaded fastener 40 may be used and preferably is a fastener that can be repeatedly turned clockwise or counterclockwise by the application of an external force, such as a bolt or screw. Similarly, the fastener 40 may have any suitable style of head 42. For example, the fastener 40 illustrated in FIG. 2 has a circular, slotted head 42 for tightening with a driver. In some cases, however, it may be desirable to provide a fastener 40 having a shear head, such as a square or hex head fastener, that can be tightened with a socket wrench or a torque wrench for consistent, even tightening of the fastener 40 to a desired torque regardless of the user.

The busbar assembly 10 may have any desired number of cable holders 60 and corresponding cable ports 22, which may depend on the number of cables 30 to be connected. In operation, at least one cable 30 connected to a power source is provided to pass electric current into the busbar assembly 10 and at least one cable 30 is provided to conduct that electric current away from the busbar assembly 10 for distribution, although the total number of cables 30 varies and typically depends on the number of places to which power is to be distributed.

Figure 4:
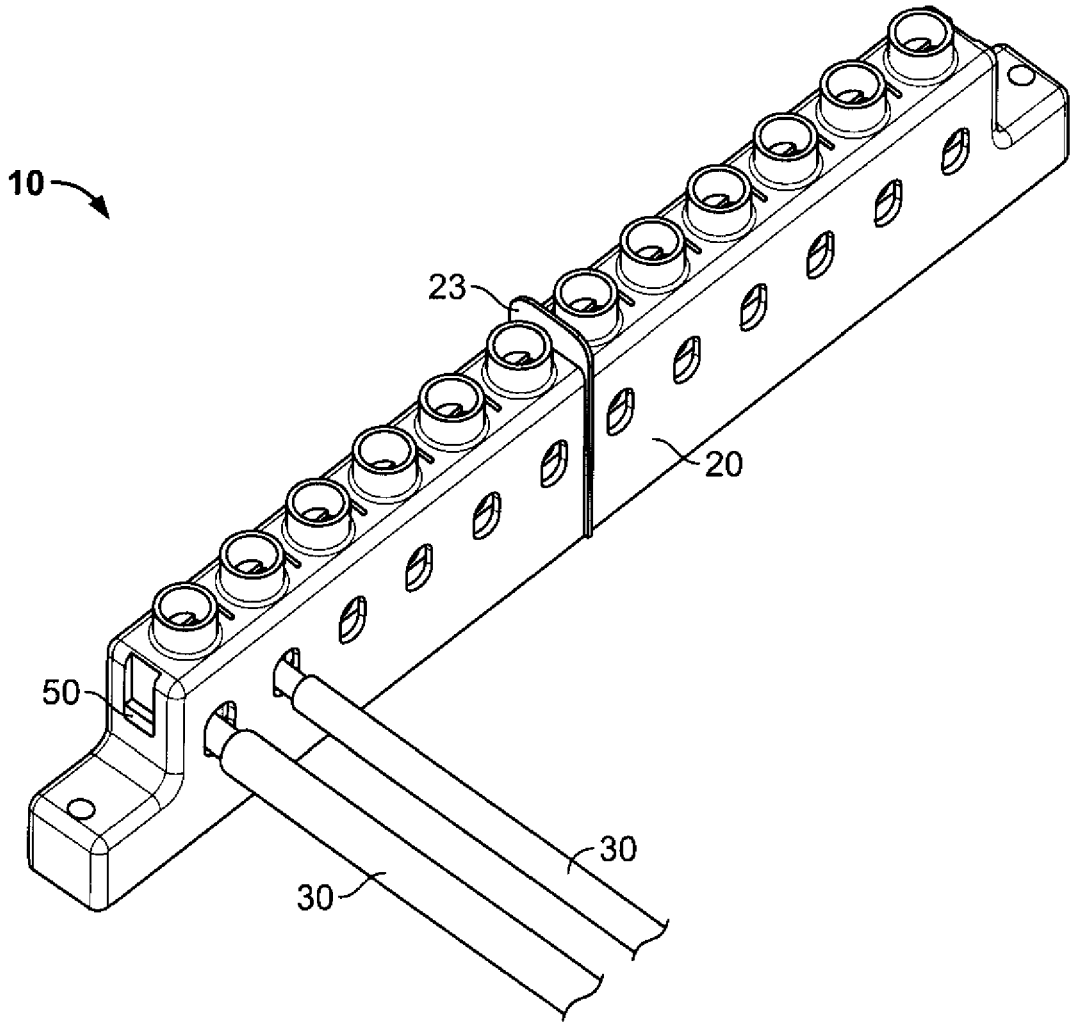
FIG. 4 illustrates a busbar assembly in accordance with another exemplary embodiment of the invention.

It may also be desirable to use a single busbar assembly 10 for connecting multiple phases, i.e., when incoming current is to be provided by cables 30 on separate circuits for separate outgoing distribution. In that case, as illustrated in FIG. 4, one or more insulating divider walls 23 may be placed or formed within the housing 20, which is used in combination with multiple conductive bars 50 secured in the housing 20. The divider wall(s) 23 separates and electrically insulates the conductive bars 50 from one another on opposite sides of the wall 23. Thus, FIG. 4 illustrates a busbar assembly 10 having two phases with one conductive bar 50 for each phase, each phase with six ports (typically for one incoming and up to five outgoing cables), while FIG. 1, which has a single conductive bar 50 and no divider wall, has a single phase and twelve ports to accommodate up to eleven outgoing cables for distribution.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A busbar assembly comprising:

an electrically insulating busbar housing having a plurality of cable ports and fastener ports formed therein;

a plurality of threaded fasteners having a fastener axis, each fastener positioned in a different fastener port of the busbar housing;

a substantially solid electrically conductive bar supported and positioned within the busbar housing; and a plurality of cable holders, wherein the conductive bar extends through the cable holders, each cable holder having a threaded fastener aperture configured to receive the threaded fastener and a cable aperture configured to receive an electrically conductive cable, wherein the threads of the fastener are engaged with the threads of the fastener aperture and wherein the cable aperture is aligned with a corresponding cable port of the busbar housing.

2. The busbar assembly of claim 1 wherein each cable holder is positionally adjustable in a direction coincident the fastener axis.

3. The busbar assembly of claim 2 wherein the cable holder is adjustable from a first position to receive an electrically conductive cable to a second position to retain the cable in contact with the conductive bar by actuating the threaded fastener in one of a clockwise or counterclockwise direction.

4. The busbar assembly of claim 1 wherein the cable holder is configured in a ring.

5. The busbar assembly of claim 4 wherein the cable holder is a unitary band of material biased away from a first, unbiased configuration, wherein the cable holder includes two threaded fastener apertures in substantial registration with one another in the ring configuration, wherein the threads of the fastener are at least partially engaged with the threads of each fastener aperture and wherein the fastener at least partially prevents the cable holder from returning to its unbiased configuration.

6. The busbar assembly of claim 1, wherein the cable holder has two cable apertures aligned with the corresponding cable port.

7. The busbar assembly of claim 1 wherein the conductive bar comprises a first metal overplated by a second metal.

8. The busbar assembly of claim 1 comprising two conductive bars electrically isolated from one another by an insulating divider wall in the busbar housing.

9. The busbar assembly of claim 1 wherein the cable holder is an electrically conductive material.

10. The busbar assembly of claim 1 wherein the fastener is an electrically conductive material.

11. The busbar assembly of claim 1 wherein the fastener has a square head or a hex head.

12. A busbar assembly comprising:

an electrically insulating busbar housing having a plurality of cable ports and fastener ports formed therein wherein the busbar housing further includes a ledge and an end rib opposite the ledge adjacent each end of the busbar housing;

a plurality of threaded fasteners having a fastener axis, each fastener positioned in a different fastener port of the busbar housing;

a substantially solid electrically conductive bar supported and positioned within the busbar housing between the ledges and the end ribs; and a plurality of cable holders having a ring configuration, the conductive bar extending through the cable holders, wherein each cable holder is a unitary band of material biased away from a unbiased linear configuration having two threaded fastener apertures and a cable aperture, wherein the threads of the fastener are engaged with the threads of each fastener aperture and wherein the cable aperture is in substantial registration with a corresponding cable port of the busbar housing.

13. The busbar assembly of claim 12 further comprising a plurality of ribs positioned intermediate the ends of the busbar housing.

14. The busbar assembly of claim 12 wherein the busbar housing includes a parapet extending away from the surface of the busbar housing at the fastener port.

15. The busbar assembly of claim 12 comprising two conductive bars electrically isolated from one another by a divider wall in the busbar housing.

16. The busbar assembly of claim 12 wherein the fastener has a square head or a hex head.

17. The busbar assembly of claim 12 wherein the conductive bar is tin overplated with copper.

* * * * *